US011672365B2

(12) United States Patent
Young-Loaeza

(10) Patent No.: US 11,672,365 B2
(45) Date of Patent: Jun. 13, 2023

(54) BED SHEET

(71) Applicant: Ruth Young-Loaeza, San Diego, CA (US)

(72) Inventor: Ruth Young-Loaeza, San Diego, CA (US)

( * ) Notice: Subject to any disclaimer, the term of this patent is extended or adjusted under 35 U.S.C. 154(b) by 224 days.

(21) Appl. No.: 17/127,990

(22) Filed: Dec. 18, 2020

(65) Prior Publication Data

US 2021/0127863 A1 May 6, 2021

Related U.S. Application Data

(63) Continuation of application No. 16/789,728, filed on Feb. 13, 2020, now Pat. No. 10,888,182, which is a continuation of application No. 15/846,116, filed on Dec. 18, 2017, now Pat. No. 10,561,257.

(60) Provisional application No. 62/555,284, filed on Sep. 7, 2017.

(51) Int. Cl.
*A47G 9/02* (2006.01)

(52) U.S. Cl.
CPC ..... *A47G 9/0246* (2013.01)

(58) Field of Classification Search
CPC ..... A47G 9/0246
See application file for complete search history.

(56) References Cited

U.S. PATENT DOCUMENTS 311,688 A 2/1885 Swanson
1,359,526 A 11/1920 Ray
2,624,893 A * 1/1953 Harris ..... A47C 31/105 5/497
2,682,062 A * 6/1954 Cogan ..... A47G 9/0246 5/496
2,942,280 A 6/1960 May, Jr.
3,111,688 A 11/1963 Barnes
3,114,156 A 12/1963 Cobb
(Continued)

FOREIGN PATENT DOCUMENTS

DE 2829873 A2 1/1980
EP 0425466 A1 5/1991
(Continued)

OTHER PUBLICATIONS

AU Lit Fine Linens, Size Charte, Aug. 26, 2017, https://www.aulitfinelinens.com/lbogs/tips-advice/size-Chart, 1 page.
(Continued)

*Primary Examiner* — Eric J Kurilla
(74) *Attorney, Agent, or Firm* — Lee & Hayes, P.C.

(57) ABSTRACT

A fitted bed sheet that includes a top sheet. An upper edge sheet strip is attached to the top sheet along a lateral edge of the top sheet such that the length of the upper edge sheet is coupled with the lateral edge of the top sheet. The width of the upper edge sheet strip is defined such that at least a portion of the upper edge sheet strip extends orthogonally to the surface of the mattress so as to stretch over a portion of a side of the mattress. A corner sheet has: a first end attached to the top sheet, a corner sheet side attached to the upper edge sheet strip, and a second end opposite the first end. The second end includes an elastic cord with which, when the fitted bed sheet is placed on the mattress, the fitted bed sheet captures a corner of the mattress.

18 Claims, 5 Drawing Sheets

(56) References Cited

U.S. PATENT DOCUMENTS

| | | | | |
|---|---|---|---|---|
| 3,142,072 | A | 7/1964 | Goodson, Jr. | |
| 4,461,049 | A | 7/1984 | Hammond | |
| 4,672,702 | A * | 6/1987 | Isham | A47G 9/02 5/497 |
| 4,704,753 | A | 11/1987 | Lunt | |
| 4,727,608 | A | 3/1988 | Joyce | |
| 4,734,947 | A | 4/1988 | Vitale | |
| 4,912,790 | A | 4/1990 | Macdonald | |
| 4,980,941 | A | 1/1991 | Johnson, III | |
| 5,046,207 | A | 9/1991 | Chamberlain | |
| 5,230,111 | A | 7/1993 | Davis | |
| 5,247,893 | A | 9/1993 | Zafiroglu | |
| 5,249,322 | A | 10/1993 | Seago | |
| 5,287,674 | A | 2/1994 | Sperber | |
| 5,636,393 | A | 6/1997 | Zafiroglu et al. | |
| 5,749,110 | A | 5/1998 | Gamble et al. | |
| 6,499,157 | B1 | 12/2002 | McCain et al. | |
| 6,983,500 | B2 * | 1/2006 | Wootten | A47G 9/0246 5/497 |
| 7,398,570 | B2 | 7/2008 | Seago | |
| 8,015,636 | B2 * | 9/2011 | Bolish | A47G 9/0238 5/497 |
| 8,640,282 | B2 | 2/2014 | Maguire et al. | |
| D715,582 | S * | 10/2014 | Mun | D6/602 |
| 8,904,581 | B2 | 12/2014 | Rabbany et al. | |
| D742,660 | S | 11/2015 | Oberwelz et al. | |
| D746,084 | S | 12/2015 | Jensen et al. | |
| 9,314,059 | B2 | 4/2016 | Kanayama | |
| 9,510,698 | B1 * | 12/2016 | Krotova | A47G 9/0246 |
| 10,251,498 | B1 * | 4/2019 | Feldman | A47G 9/0246 |
| D915,787 | S * | 4/2021 | Tak | D6/596 |
| 11,399,643 | B2 * | 8/2022 | Jain | A47G 9/04 |
| 2003/0019037 | A1 | 1/2003 | Michaelis et al. | |
| 2005/0011007 | A1 | 1/2005 | Lintner | |
| 2007/0056100 | A1 | 3/2007 | Stewart | |
| 2007/0266495 | A1 | 11/2007 | Stribling | |
| 2008/0028522 | A1 | 2/2008 | Atwood | |
| 2008/0155749 | A1 | 7/2008 | Stevens | |
| 2008/0263768 | A1 | 10/2008 | Balasundharam | |
| 2011/0314604 | A1 | 12/2011 | Hoo | |
| 2012/0054962 | A1 * | 3/2012 | Agarwall | A47G 9/0246 5/497 |
| 2012/0324646 | A1 | 12/2012 | Briganti | |
| 2013/0042411 | A1 | 2/2013 | Vitale | |
| 2014/0150181 | A1 | 6/2014 | Tulloch | |
| 2014/0366270 | A1 | 12/2014 | Garlock | |
| 2015/0020311 | A1 | 1/2015 | Bensoussan | |
| 2015/0327696 | A1 | 11/2015 | Patterson | |
| 2016/0007774 | A1 | 1/2016 | Kakabeeke | |
| 2016/0073798 | A1 * | 3/2016 | Pawlikowski | A47G 9/0246 297/219.1 |
| 2016/0081497 | A1 * | 3/2016 | Keinigs | A47G 9/0246 24/381 |
| 2018/0008065 | A1 * | 1/2018 | Mun | D05B 3/12 |
| 2019/0069696 | A1 | 3/2019 | Young | |
| 2020/0352365 | A1 | 11/2020 | Young-Loaeza | |

FOREIGN PATENT DOCUMENTS

| | | | |
|---|---|---|---|
| EP | 0787451 | A2 | 8/1997 |
| EP | 1946679 | A1 | 7/2008 |
| EP | 2087815 | | 8/2009 |

OTHER PUBLICATIONS

Final Office Action dated Apr. 2, 2019 for U.S. Appl. No. 15/846,116 "Bed Sheets and Related Methods" Loaeza, 16 pages.

No-Final Office Action dated Oct. 2, 2019 for U.S. Appl. No. 15/846,116 "Bed Sheets and Related Methods" Loaeza, 9 pages.

Office action for U.S. Appl. No. 15/846,116. dated Aug. 31, 2018, Young, "Bed Sheets and Related Methods", 10 pages.

* cited by examiner

BED SHEET

CROSS-REFERENCE TO RELATED APPLICATIONS

This application is a continuation of and claims priority to U.S. patent application Ser. No. 16/789,728, filed Feb. 13, 2020, which is a continuation of and claims priority to U.S. patent application Ser. No. 15/846,116, filed Dec. 18, 2017, now issued as U.S. Pat. No. 10,561,257, which claims priority to U.S. Provisional Patent Application No. 62/555,284, filed on Sep. 7, 2017, which applications and patent are hereby incorporated in their entireties by reference.

BACKGROUND

The disclosed subject matter is in the field of mattress covers and bedding. More specifically, the disclosed subject matter features bed sheets with adjustable components and elements to improve the efficiency of dressing a mattress and securing the integrity of the bed sheet when on a mattress.

Mattress coverings and sheets are essential components for providing a comfortable sleeping environment and they also provide protection for both the mattress and user. Mattress decor is also a central and key aspect of a bedroom. Significant funds and societal value are invested in the aesthetic task of arranging a sheet on the bed.

Mattresses come in a variety of sizes, and, therefore, many types of mattress coverings covering a variety of dimensions have been designed to accommodate the various mattress sizes. The introduction of supplemental mattress pads have only added to the field of possible mattress dimensions. As a result, mattress coverings have to be purchased to fit each respective mattress size separately.

Furthermore, conventional bed sheets may rip apart or tear in the middle of the sheet due to stretching and fatigue. Additionally, the stitching or fabric around the edges and corners may also rip or tear due to wear and tear after repeated pulling and tugging from putting sheets on a bed.

Also, in some households, people have plastic mattress protectors over their mattresses, which results in a traditional bed sheet slipping off of the mattress.

Covering a mattress can be a time consuming and labor intensive project, especially for professions that require repetitive stripping and recovering of mattresses. Additionally, many people do not enjoy making a bed because of the frustrations that come with trying to put a bed sheet on a bed. Furthermore, studies have shown that prolonged leaning during bed-making leads to musculoskeletal disorders. (See Silva J S Jr., et. al., Evaluation of Lumbar Overload in Hotel Maids, US National Institutes of Health (2012).

In addition to the time and effort it takes to make a bed, current bed sheets can often come undone/untucked from the mattress when a user moves on top of the bed sheet, thereby causing the sheet to be tugged and pulled out from under the mattress.

Therefore, a need exists for an efficient and adjustable mattress covering system. A need also exists to stop the sheet from being pulled out from under the mattress by reason of user movement on top of the sheet when on the mattress. Accordingly, a solution may be sought for an easier and more efficient process of dressing a mattress with a bed sheet. Further, it is also desired for the bed sheet to better stay on the mattress when a user moves around on top of the sheet.

SUMMARY

The instant disclosure discusses coverings for a mattress that improve the efficiency of putting the coverings on the mattress. Hereinafter, the term "mattress covering" may interchangeably refer to a "bed sheet" and vice versa. Moreover, the term "bed sheet" may naturally include fitted or flat sheets.

The instant disclosure discusses a mattress covering that may include elastic members sewn into the top edge and corners of the mattress covering. The elastic members permit flexibility and stretching of the mattress covering. The elastic members may also prevent the mattress covering from ripping or tearing in the middle or along the edges and corners, which may occur from repeated tugging and pulling of the mattress covering. An advantage of the subject matter of the instant disclosure may be to maintain the integrity of the fitted mattress covering once spread over a mattress and to allow for more efficient mattress dressing. Another advantage of the subject matter of the instant disclosure may be to prevent the fabric or stitching on bed sheets from ripping or tearing in the middle or around the edges and corners of the bed sheet.

The instant disclosure also contemplates a flat sheet that may be used as a blanket.

The instant disclosure also contemplates a flat sheet that looks like a bed cover when a portion of the flat sheet is untucked from the mattress.

The instant disclosure also contemplates a bed sheet that may not slip off when there is a plastic mattress protector under the bed sheet.

The instant disclosure also contemplates a bed sheet that may include parallel drawstrings extending along the length of the bed sheet. Pulling the drawstrings may cause a progressive gathering of the bed sheet's distal end, resulting in a shortened and gathered coverage of the bed sheet over a portion of the mattress. Thus, the user may adjust the length of the bed sheet via the drawstrings. Further, the drawstrings may be tied together to secure the adjusted bed sheet at a desired length. The bed sheet may also include stitched corners on the distal end of the bed sheet to permit the securement of the distal end of the bed sheet to the mattress through enveloping and gripping the end surface of the mattress. Once secured to the end of the mattress, the remaining portion of the bed sheet may be pulled longitudinally to cover the top surface of the mattress.

The instant disclosure also contemplates additional fabric covering the stitched distal corners of the bed sheet. In one embodiment, the bed sheet covers the top surface of the mattress, while the additional fabric (sewn into the distal end of the bed sheet) lays over the distal end of the mattress covering the side of the mattress, as well as the stitched corners, thereby providing a more complete and aesthetically pleasing mattress covering presentation. The length of the additional fabric permits the fabric to be tucked underneath the mattress.

The instant disclosure also contemplates a slit in the bed sheet, configured to allow air to escape from the space between the mattress and the sheet when applied to the bed.

The instant disclosure also contemplates an apparatus that attempts to minimize user time expenditure and effort in dressing a mattress.

BRIEF DESCRIPTION OF THE DRAWINGS

Other objectives of the disclosure will become apparent to those skilled in the art throughout the description. The manner in which these objectives and other desirable characteristics can be obtained is explained in the following description and attached figures in which.

DETAILED DESCRIPTION OF THE DRAWINGS

Figure 1:
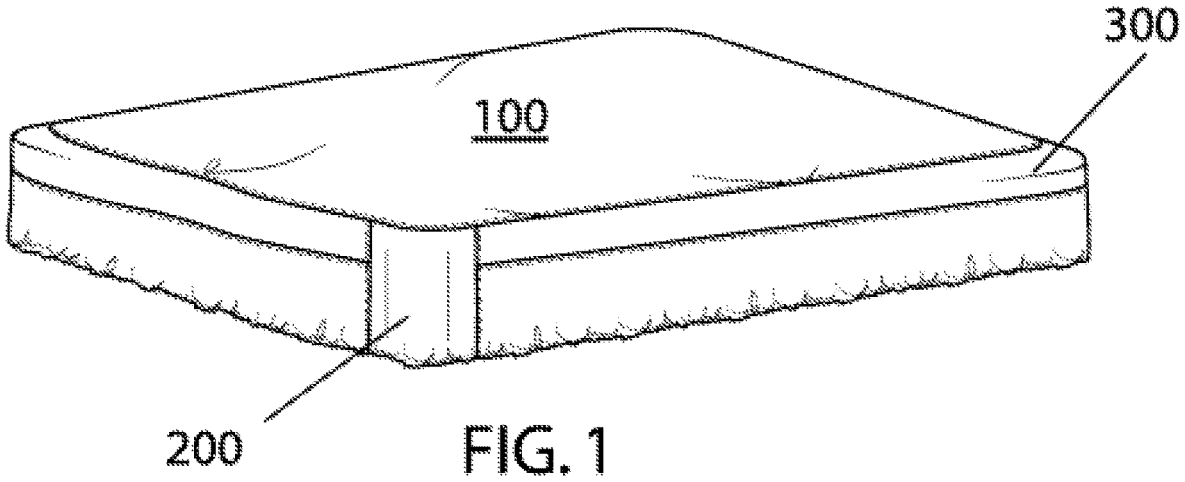
FIG. 1 is a perspective view of a bed sheet covering a mattress according to an embodiment of the instant disclosure.

Generally disclosed is a bed sheet that allows for adjustable, easy, and efficient application of a bed sheet to a mattress and with a mechanism that allows for movement of the sheet without it coming undone from the mattress. FIG. 1 is a perspective view of one embodiment of the bed sheet 100. Referring to FIG. 1, in one embodiment, the bed sheet 100 may be a fitted sheet with stretchable material sewn into the edges 300 and corners 200 of the bed sheet 100. Like a generic fitted sheet, the bed sheet 100 may also feature elastic along the perimeter of the bottom of the bed sheet 100 to fit under the bottom of a mattress. The stretchable edge 300 and corner 200 may be composed of a stretchable material, such as lycra, spandex, elastane, elastic, or other stretch fabric. The stretchable edge 300 and corner 200 allow a user to move around on the bed and pull and tug the material on the top of the mattress without pulling portions of the bed sheet 100 out from under the mattress. That is, the stretchable edges 300 and corners 200 allow the portion of the bed sheet 100 on top of the mattress to move without interfering with the integrity of the sides and corner of the bed sheet that keep it secure on the mattress.

Figure 2:
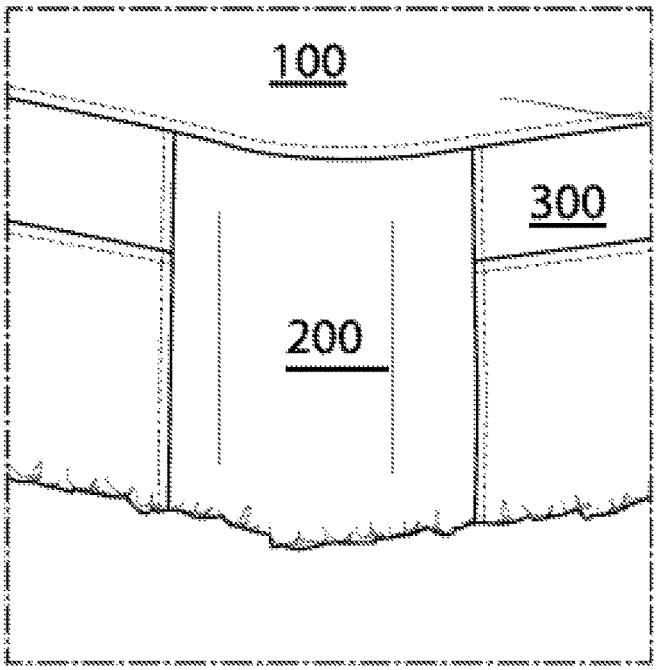
FIG. 2 is a partial detailed view of the corner of the bed sheet of FIG. 1 when covering a mattress.

FIG. 2 is a partial detailed view of the corner 200 of the bed sheet 100. Referring to FIG. 2, the "T" or "Y" shaped formation of the stretchable corners 200 and edges 300 are configured to allow for easy application of the bed sheet 100 on a mattress because when a user puts a sheet on mattress, he or she generally starts by slipping the sheet under one corner of the mattress as an anchor point and applying the remainder of the sheet by pulling and tugging the sheet from the secured corner and tucking in the remainder of the bed sheet 100 under the remaining corners and edges of the mattress.

Figure 3:
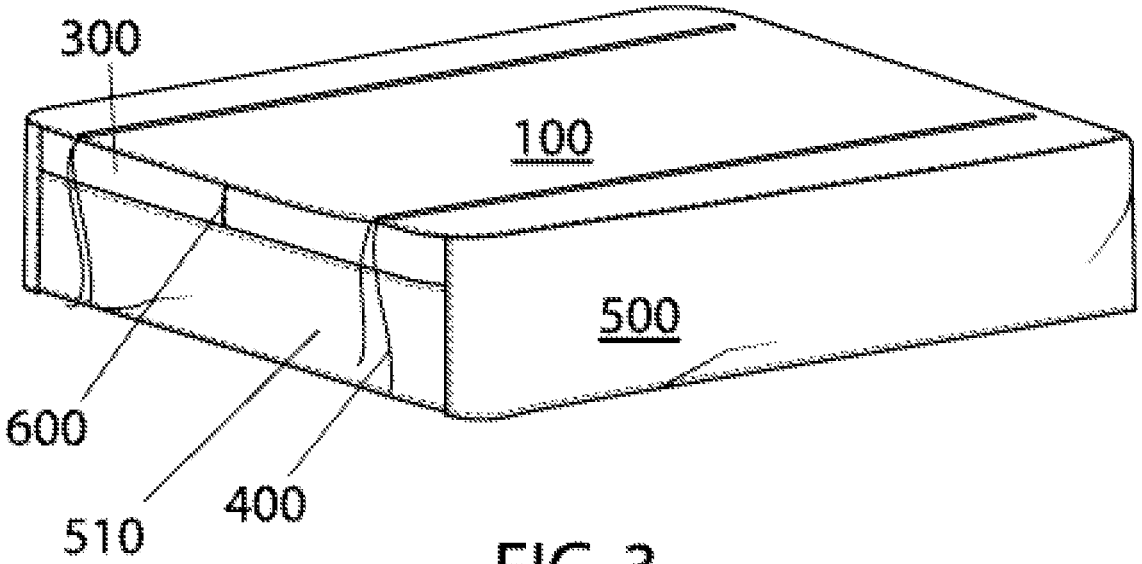
FIG. 3 is a perspective view of a bed sheet covering a mattress with a side flap laid down over the side of the mattress according to an embodiment of the instant disclosure.
Figure 4:
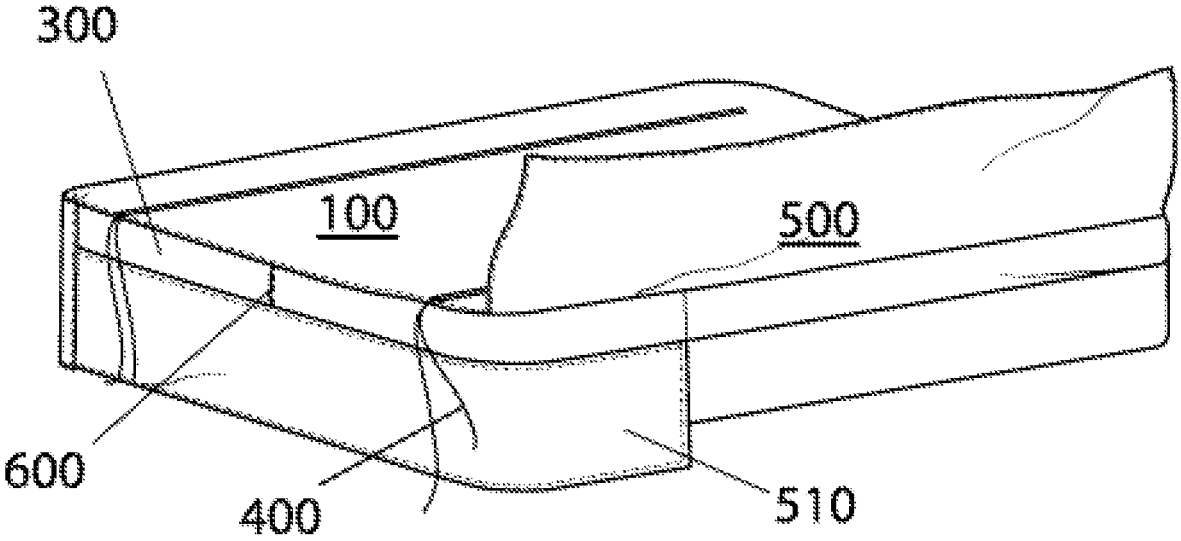
FIG. 4 is a perspective view of the bed sheet of FIG. 3 covering a mattress with the side flap lifted up revealing the underlying mattress.

FIGS. 3 and 4 are perspective views of one embodiment of the bed sheet 100. Referring to FIGS. 3 and 4, the bed sheet 100 is shown as a flat sheet that features side flaps 500 which hang down from the edge of the mattress along the length of the bed sheet 100. In an alternative embodiment, the side flaps 500 may hang down from three sides of the bed sheet 100. Referring to FIG. 4, the bed sheet 100 may be a flat sheet and feature an end flap 510 sewn into the end of the bed sheet 100 so that it wraps around and extends past a portion of the bottom two corners of the mattress. This allows for the end flap 510 to "catch" onto the end of the mattress and allow the user to easily pull the bed sheet 100 across the remainder of the mattress. That is, this end flap 510 allows for an easier and more efficient application of a flat sheet to a mattress because the end flaps 510 may be placed over the bottom of the mattress and then the bed sheet 100 is pulled in the opposite direction until the end flaps 510 catch against the corners and bottom of the mattress, wherein the bed sheet 100 becomes taut. Once the bed sheet 100 is taut, the side flaps 500 may be tucked in and under the remaining sides of the mattress. In an alternative embodiment, the bed sheet 100 has both ends defined by the end flap 510 and it may be used as a bottom flat sheet that is placed beneath another bed sheet 100 with only one end flap 510.

Figure 8:
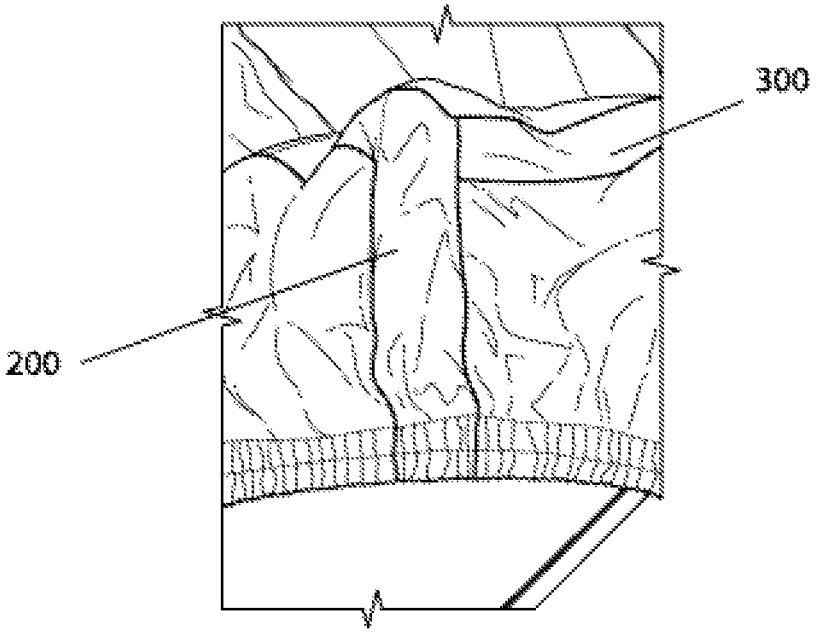
FIG. 8 is a partial detailed view of an elastic corner and stretchable edging of a bed sheet according to an embodiment of the instant disclosure.

FIGS. 1, 2 and 8 show the stretchable corner 200. In one embodiment, the stretchable corner 200 anchors the bed sheet 100 through catching and attaching to the edges of a mattress in a hooking fashion. Once anchored around the mattress edge, the bed sheet 100 may be pulled flat along the top length of the mattress covering it entirely.

Still referring to FIGS. 3 and 4, the bed sheet 100 may feature a drawstring 400, wherein the drawstring 400 extends along the length of the bed sheet 100. In another embodiment, the drawstring 400 may extend only along a portion of the length of the bed sheet 100, for example, the drawstring 400 may extend along half the length of the bed sheet 100 or along a third of the length of the bed sheet 100. In an embodiment, the drawstring 400 is positioned on the bed sheet 100 wherein it is several inches inside of the edge of the mattress. That is, there is a portion of space between the drawstring 400 and the edge of the bed sheet 100 when it is on the mattress.

Still referring to FIG. 4, in an embodiment, the stretchable edge 300 only extends along the length of end flap 510.

Figure 5:
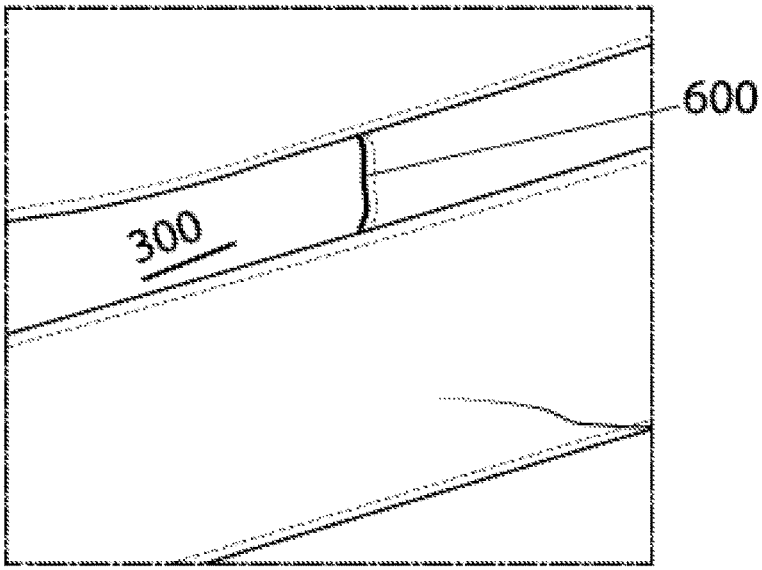
FIG. 5 is a partial detailed view of stretchable edging and a slit of a bed sheet according to an embodiment of the instant disclosure.

FIG. 5 is a partial detailed view of the end of one embodiment of the bed sheet 100. Referring to FIG. 5, in one embodiment, the bed sheet 100 may feature a slit 600. The slit 600 allows air to escape from the under the bed sheet 100 when applied to a mattress. Frequently, there is an air bubble that is created when a bed sheet 100 is put onto a mattress, so the slit 600 allows for air to escape more quickly and allows a user to push air out of the slit 600. In an alternative embodiment, the slit 600 may be used to access a plug for an air mattress, permitting attachment of an air pump without having to strip the coverings off the mattress.

Figure 6:
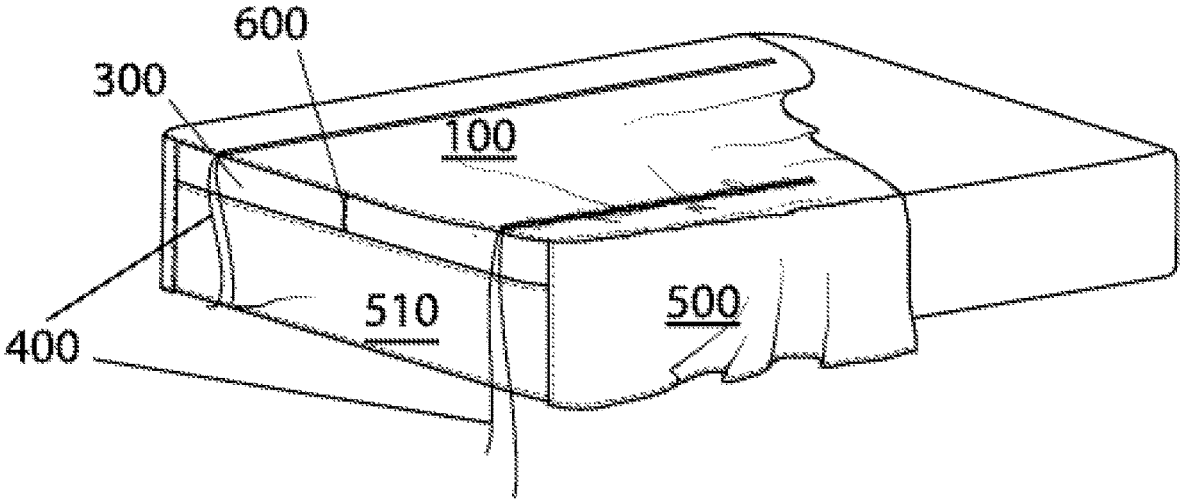
FIG. 6 is a perspective view of a bed sheet covering a mattress with drawstrings for shortening the bed sheet according to an embodiment of the instant disclosure.
Figure 7:
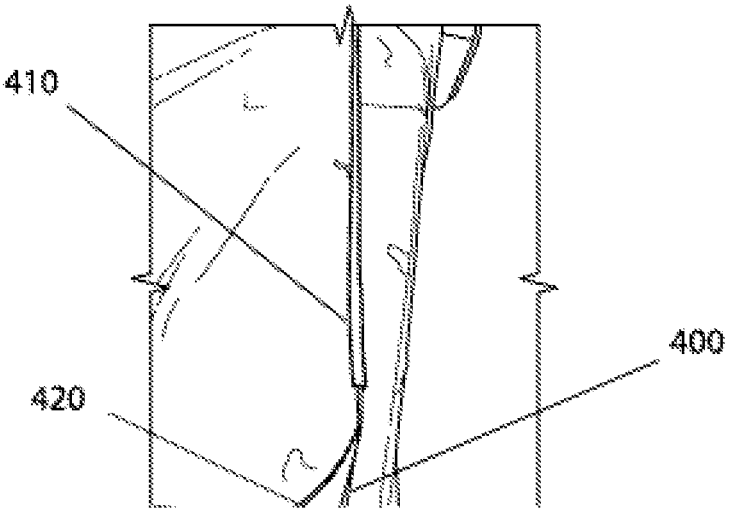
FIG. 7 is a perspective view of the drawstrings of FIG. 6 with the bed sheet in an elongated configuration according to an embodiment of the instant disclosure.

FIG. 6 is a perspective view of the drawstring 400 pulled, wherein the length of the sheet is shortened and the material of the bed sheet 100 is gathered. FIG. 7 is a partial detailed view of the drawstring 400. Referring to FIG. 7, the bed sheet 100 features a drawstring cavity 410, wherein the drawstring 400 is sewn into one end and housed. Referring to FIG. 7, there is also shown a tie-off string 420 sewn into the drawstring cavity 410, which allows a user to tie a knot with the drawstring 400 and the tie-off string 420 to secure the drawstring 400 in place and secure the adjusted length of the bed sheet 100 in place. Referring to FIGS. 3, 4, 6, and 7, in use, if a user wants to shorten the length of the bed sheet 100, the user may grab the tie-off string 420 or a portion of the bed sheet 100 and pull the drawstring 400, which will cause the bed sheet 100 to gather and shorten (see FIG. 6). In one embodiment, the bed sheet 100 may feature just the drawstring cavity 410, drawstring 400, and tie-off string 420. In an alternative embodiment, the bed sheet 100 may only feature the stretchable edge 300, at least one end flap 510, and at least one side flap 500.

FIG. 8 is a partial detailed view of one embodiment of the bed sheet 100 with the stretchable corners 200 and edges 300.

Figure 9:
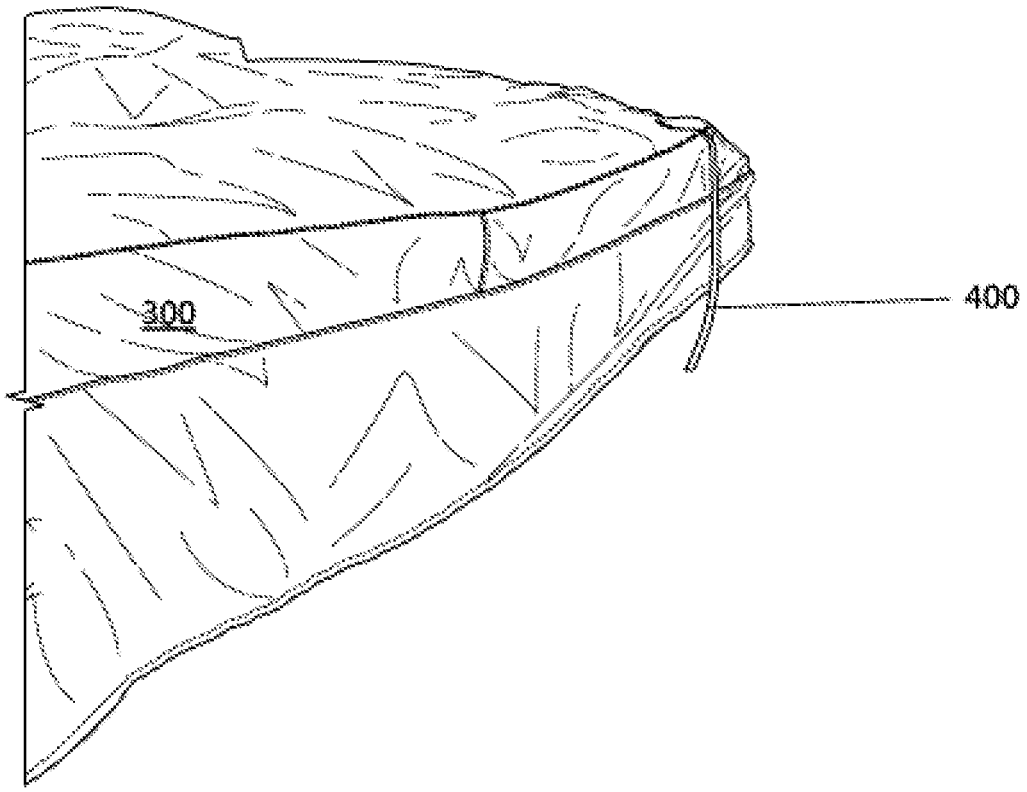
FIG. 9 is a perspective view of a bed sheet covering a mattress with drawstrings relaxed and the bed sheet in an elongated configuration according to an embodiment of the instant disclosure.

FIG. 9 is a perspective view of the end of one embodiment of the bed sheet 100.

In an embodiment, the bed sheet 100 completely encompasses the mattress with the stretchable corners 200 and stretchable edging 300 extending between the panels of the bed sheet 100.

FIGS. 3, 4 and 6 show the bed sheet 100 side flaps 500. In one embodiment, the side flaps 500 may be laid across a mattress edge covering the edge. In another embodiment, the side flaps 500 may be tucked underneath the mattress for a different aesthetic appearance.

In one embodiment, the bed sheet 100 may be 90 inches in width and 87 inches in length. In an alternative embodiment, the bed sheet may be 108 inches in width and 102 inches in length, wherein the end flap may be 14 inches in length. In an alternative embodiment, the bed sheet 100 may be 81 inches in width and 96 inches in length. In another embodiment, the bed sheet 100 may be 66 inches in width and 96 inches in length. In an embodiment, the stretchable edge may be 4 inches in height and is sewn into the edges of the bed sheet 100. In an embodiment, the stretchable corner is 4 inches in width and sewn into the corners of the bed sheet 100.

In an embodiment, the bed sheet 100 may be a fitted sheet, wherein the bottom elastic that wraps under the mattress and secures the bed sheet 100 on a mattress is in a range from one to three and a half inches (1"-3½"). This allows for a more taut fit around the mattress, wherein the bed sheet 100 exhibits less gathering and ruffling around the sides of the mattress. That is, the wider elastic provides a more secure and taut fit.

The bed sheet 100 may facilitate a more efficient process of making a bed and putting a bed sheet on a mattress because of the unique configuration of end flaps 510, side flaps 500, and stretchable edge 300. As a result, the bed sheet 100 may cut the amount of time to make a bed in half. That is, it may take 8-10 minutes to make a bed with traditional sheets, but with a bed sheet 100 as disclosed herein, it may reduce the time to make a bed to 3-4 minutes. In the hospitality industry, this allows hotels to make beds more quickly and more efficiently, thereby, saving time and money.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

All original claims submitted with this specification are incorporated by reference in their entirety as if fully set forth herein.

I claim:

1. A fitted bed sheet sized to cover a mattress defined by a dimension that extends in a first direction and a dimension that extends in a second direction that is perpendicular to the first direction, the fitted bed sheet comprising:

a top sheet that extends, with respect to the mattress:

in the first direction of the mattress across a surface thereof, and in the second direction of the mattress across the surface thereof;

at least one upper edge sheet strip defined dimensionally by a length thereof that is longer than a width thereof, the at least one upper edge sheet being attached to the top sheet along a lateral edge of the top sheet such that the length of the at least one upper edge sheet is coupled with the lateral edge of the top sheet, and the width of the at least one upper edge sheet strip being defined such that, when the fitted bed sheet is placed on the mattress, at least a portion of the at least one upper edge sheet strip extends orthogonally to the surface of the mattress so as to stretch over a portion of a side of the mattress; and at least one corner sheet having:

a first end that is attached to a corner of the top sheet, a corner sheet side that is attached to the at least one upper edge sheet strip along the width direction of the at least one upper edge sheet strip, and a second end opposite the first end, the second end including an elastic cord with which, when the fitted bed sheet is placed on the mattress, the at least one corner sheet captures a lower corner of the mattress, wherein the at least one upper edge sheet strip includes:

a first part that is attached to the top sheet, and a second part that extends from and along the first part, wherein a fabric of the first part of the at least one upper edge sheet strip is more stretchable than a fabric of the second part of the at least one upper edge sheet strip.

2. The fitted bed sheet of claim 1, wherein the at least one upper edge sheet strip includes an elastic material.

3. The fitted bed sheet of claim 1, wherein the at least one corner sheet includes an elastic material.

4. The fitted bed sheet of claim 1, wherein the at least one upper edge sheet strip has a first length side and a second length side opposite the first length side, the first length side being attached to the top sheet, and wherein the second part of the at least one upper edge sheet strip is a lower sheet strip that is attached to:

the second length side of the first part of the at least one upper edge sheet, and the corner sheet side, and wherein the lower strip sheet includes elastic cord that extends along a bottom edge thereof in alignment with the elastic cord in the second end of the at least one corner sheet.

5. The fitted bed sheet of claim 1, wherein a fabric of the top sheet is less stretchable than a fabric of the at least one upper edge sheet strip.

6. The fitted bed sheet of claim 1, wherein a fabric of the top sheet is less stretchable than a fabric of the at least one corner sheet.

7. The fitted bed sheet of claim 1, wherein a fabric of the at least one corner sheet is the same as a fabric of the at least one upper edge sheet strip.

8. A fitted bed sheet comprising:

a top sheet;

an upper edge sheet strip including a first part and a second part, the first part attached to the top sheet along a lateral edge of the top sheet such that a length of the upper edge sheet is coupled with the lateral edge of the top sheet, a width of the upper edge sheet strip is defined such that at least a portion of the upper edge sheet strip extends orthogonally to the top sheet, the second part attached to the first part opposite the top sheet, and a fabric of the first part being more stretchable than a fabric of the second part; and a corner sheet including:

a first end attached to the top sheet, a corner sheet side attached to the upper edge sheet strip, and a second end opposite the first end, the second end including an elastic cord with which, when the fitted bed sheet is placed on a mattress, the corner sheet captures a corner of the mattress.

9. The fitted bed sheet of claim 8, wherein a fabric material of the upper edge sheet strip includes elastane.

10. The fitted bed sheet of claim 8, wherein a fabric material of the corner sheet includes elastane.

11. The fitted bed sheet of claim 8, wherein the corner sheet is a first corner sheet, wherein the upper edge sheet strip is a first upper edge sheet strip, wherein the fitted bed sheet further comprises:

a second corner sheet, a third corner sheet, and a fourth corner sheet, each being attached to the top sheet; and a second upper edge sheet strip, a third upper edge sheet strip, and a fourth upper edge sheet strip, each being attached to the top sheet, and wherein each of the first upper edge sheet strip, the second upper edge sheet strip, the third upper edge sheet strip, and the fourth upper edge sheet strip are positioned, respectively, between laterally adjacent corner sheets of the first corner sheet, the second corner sheet, the third corner sheet, and the fourth corner sheet.

12. The fitted bed sheet of claim 8, further comprising a lower sheet strip connected to the corner sheet, the lower sheet strip extending along a bottom edge thereof in alignment with the elastic cord in the second end of the corner sheet.

13. The fitted bed sheet of claim 8, wherein a fabric of the top sheet is less stretchable than a fabric of the upper edge sheet strip.

14. The fitted bed sheet of claim 8, wherein a fabric of the top sheet is less stretchable than a fabric of the corner sheet.

15. A fitted bed sheet comprising:

a top sheet;

an upper edge sheet strip attached to the top sheet along a lateral edge of the top sheet such that a length of the upper edge sheet is coupled with the lateral edge of the top sheet, and a width of the upper edge sheet strip is defined such that at least a portion of the upper edge sheet strip extends orthogonally to the top sheet;

a corner sheet including:

a first end attached to the top sheet, a corner sheet side attached to the upper edge sheet strip, and a second end opposite the first end, the second end including an elastic cord with which, when the fitted bed sheet is placed on a mattress, the corner sheet captures a corner of the mattress; and a lower edge sheet strip that is attached to:

the upper edge sheet, and the corner sheet, wherein the lower edge strip sheet includes elastic cord that extends along a bottom edge thereof in alignment with the elastic cord in the second end of the corner sheet, and wherein a fabric of the upper edge sheet strip is more stretchable than a fabric of the lower edge sheet strip.

16. The fitted bed sheet of claim 15, wherein a fabric of the upper edge sheet strip and a fabric of the corner sheet are the same.

17. The fitted bed sheet of claim 15, wherein a fabric of the top sheet and a fabric of the lower edge sheet strip are the same.

18. The fitted bed sheet of claim 15, wherein a fabric of the corner sheet is more stretchable than a fabric of the lower edge sheet strip.

* * * * *